US005366644A

United States Patent [19]

Wicks

[11] Patent Number: 5,366,644

[45] Date of Patent: Nov. 22, 1994

[54] LUBRICANT FOR FUEL

[75] Inventor: Robert T. Wicks, Richton Park, Ill.

[73] Assignee: Gold Eagle Co., Chicago, Ill.

[21] Appl. No.: 58,585

[22] Filed: May 6, 1993

Related U.S. Application Data

[63] Continuation of Ser. No. 881,122, May 11, 1992, abandoned, which is a continuation of Ser. No. 719,329, Jun. 20, 1991, abandoned.

[51] Int. Cl.[5] ..... C10M 141/02; C10L 1/18

[52] U.S. Cl. ..... 252/12; 44/398; 252/56 R; 252/56 S; 585/1; 585/3

[58] Field of Search ..... 44/398; 252/56 R, 56 S, 252/12; 585/1, 3

[56] References Cited

U.S. PATENT DOCUMENTS

| | | |
|---|---|---|
| 2,426,489 | 8/1947 | De Groote . |
| 2,793,219 | 5/1957 | Barrett et al. . |
| 2,793,220 | 5/1957 | Barrett et al. . |
| 3,036,002 | 5/1962 | Holmgren . |
| 3,114,708 | 12/1963 | Morway et al. . |
| 3,235,494 | 2/1966 | Piatt et al. . |
| 3,438,896 | 4/1969 | Council et al. . |
| 3,870,643 | 3/1975 | Kerschner et al. . |
| 3,871,837 | 3/1975 | Bedague et al. . |
| 4,515,740 | 5/1985 | Schuettenberg et al. . |
| 4,639,255 | 1/1987 | Schuettenberg et al. . |
| 4,735,734 | 4/1988 | Staub et al. . |
| 4,759,860 | 7/1988 | Tanaka et al. . |
| 4,994,196 | 2/1991 | Kagaya et al. . |

OTHER PUBLICATIONS

Unichema International, Priolube 3999—Synthetic Base Fluid For Outboard—2—Stroke Engine Lubricants. Feb 1987.

Unichema International, High Performance Ester Base 2—Stroke Oils.

*Primary Examiner*—Margaret Medley

*Attorney, Agent, or Firm*—Gerstman, Ellis & McMillin, Ltd.

[57] ABSTRACT

A new lubricant for addition to preferably two-cycle engine fuels is provided. The lubricant may be a solid lubricant in the form of a pellet having a diameter of at least 1 mm., which is readily dispersible when dropped into the fuel. Also, the lubricant of this invention preferably comprises from 25 to 75 percent of a saturated fatty acid having 12 to 22 carbon atoms; (2) from 5 to 25 weight percent of at least one of a polyisobutylene having a molecular weight of at least 800 or a polymerized, unsaturated fatty acid having an average of at least about 24 carbon atoms per polymerized molecule; and (3) from 0 to 50 weight percent of a polybasic ester of a polyol molecule and 2 to 4 fatty acid molecules, each fatty acid molecule having an average of 4 to 22 carbon atoms.

20 Claims, No Drawings

LUBRICANT FOR FUEL

This is a continuation of application Ser. No. 07/881,122, filed May 11, 1992, abandoned which, in turn, is a continuation of application Serial No. 07/719,329, filed Jun. 20, 1991, Abandoned.

BACKGROUND OF THE INVENTION

Two cycle internal combustion engines carry their lubricant in the fuel itself. The use of two cycle engines is increasing due to high power to weight requirements on such things as motorcycles, chain saws, power boats and the like.

A problem of two cycle engines is encountered in the fact that excess lubricant which is unburned causes pollution, but if an excess of lubricant is not present, the result may be a shortfall of lubricant which causes engine failure.

Also, the user of the two cycle engine typically mixes the lubricant into the fuel. Thus, mistakes are often made with respect to proper fuel mixtures, resulting in either a shortfall of lubricant which can destroy the engine, or an excess of lubricant which is undesirable in terms of pollution and undesirable smoke generation. Also, the two cycle engine lubricant generally comes at the present time in inconvenient, small cans in an attempt to overcome the difficulties that users have in mixing the fuel.

By this invention an improved lubricant is provided which may be mixed in lower concentrations with engine fuel than conventional two-cycle oil, while effectively providing lubrication, with a resulting reduction of both cost and undesirable pollution. Additionally, the lubricant of this invention may be a solid material until it is added to the fuel, which facilitates its addition by the simple counting of lubricant tablets to be added to a given amount of fuel. This also permits packaging of the lubricant in a less expensive form.

In Schuettenberg et al. U.S. Pat. Nos. 4,515,740 and 4,639,255, various fuel additives such as detergents are proposed for addition to engine fuel in pellet form. However, there is no teaching of the addition of a lubricant of any sort in pellet form. Similarly, Morway et al. U.S. Pat. No. 3,114,708 teaches dry blends made from polyolefins and oil, which blends are useful as lubricants and lubricant thickeners. Such a blend is a grease-like material. Most greases of the prior art comprise a fluid lubricant plus a filler to provide a solid material.

By this invention, a solid lubricant composition is provided which is particularly useable as an additive to two cycle engine fuel. Certain embodiments of the lubricant composition of this invention may be provided to the fuel in the form of a liquid or a solid tablet, so that it is easily measured into the fuel in desired concentration by dropping a specified number of tablets into a particular volume of fuel. Also, the preferred lubricant of this invention can be added to gasoline in lower concentrations than conventional lubricating oil, while the resulting fuel can still be successfully used in two-cycle engines. For example, preferred lubricants of this invention may be mixed with gasoline at ratios of 100:1 to 300:1 while still providing successful lubrication to the gasoline for use in two-cycle engines. Because of this, less fuel dilution occurs. Less waste, and lower smoke exhaust is also achieved.

DESCRIPTION OF THE INVENTION

By this invention, a lubricant, typically for addition to two-cycle engine fuel, is provided, in which the lubricant is substantially spontaneously dispersed in the fuel after addition, to provide a lubrication characteristic to the fuel. The solid lubricant embodiments of this invention may be in the form of a pellet preferably having a diameter of at least 1 mm. and typically not larger than 4 cm..

Preferred embodiments of the engine lubricant of this invention may be solid at at least 70° F., but also they are extremely effective to provide high lubrication at low concentrations. As stated above, preferred embodiments of the fuel of this invention can provide effective lubrication to two-cycle engine fuel at a concentration of only one part of the lubricant of this invention to 100 to 300 parts by weight of the two-cycle engine fuel.

The lubricant of this invention typically comprises (1) from 25 to 75 and preferably 25 to 60 weight percent of a saturated fatty acid preferably having 12 to 22 carbon atoms; and (2) from 5 to 40 weight percent of at least one polymer selected from the group consisting of (a) polyisobutylene having a molecular weight of at least about 800, but typically no more than about 2,000, and (b) polymerized, unsaturated fatty acids preferably having an average of at least about 24 carbon atoms per polymerized molecule. Such polymerized, unsaturated fatty acids may be made from unsaturated fatty acids having typically one carboxylic acid group per molecule such as linoleic acid, which is an 18 carbon carboxylic acid having two unsaturated groups. Such unsaturated acids can be polymerized into typically dimers and trimers via a Diels-Alder reaction or as described in U.S. Pat. Nos. 2,793,219, or 2,793,220 by other routes.

An ingredient (3) may be optionally added to the solid lubricant of this invention, typically in a concentration of from 10 to 50 weight percent, such ingredient comprising a polybasic ester of a polyol molecule and typically two to four fatty acid molecules, each fatty acid molecule typically having an average of about 4 to 22 carbon atoms. Such a polybasic ester may be made from a triol such as trimethylolpropane, which then may become a tribasic ester when it reacts with three fatty acid molecules. Dibasic esters may be formed from ethylene glycol or propylene glycol, for example with similar fatty acids. Other polybasic esters may be made from any desired polyol including sugar, glycerine, or the like, being reacted with fatty acids. Preferably, ingredients (1) and (3) comprise at least 25 percent by weight of said lubricant.

The above described lubricant mixture exhibits a high metallophilic characteristic through ingredients (1) and (3) as described above, Also, ingredient (1), the saturated fatty acid ingredient, can provide a solid phase characteristic to the lubricant of this invention. At low concentrations or where the fatty acid is absent, the lubricant may not be in solid form, but such a lubricant in accordance with this invention may still exhibit many beneficial characteristics of the invention and may be effectively used.

Ingredient (2), the polyisobutylene and/or the polymerized unsaturated fatty acid as described, comprises a lubricating agent which exhibits a high film strength. Thus, the lubricating composition formed of ingredients (1)–(3) exhibits both a good metallophilic characteristic and a high film strength, which causes the lubricant composition of this invention to be useable in lower concentration than many conventional lubricants. Additionally, ingredient (3), the polybasic ester, can provide a component to the formulation that is less viscous at high temperatures so that the lubricant combination can provide lubrication to the needle bearings, for example and other areas containing small spaces. At the same time, the high film strength component of the composition of this invention (ingredient (2)) permits good high temperature lubrication so that the composition of this invention can be used with high performance engines.

Metallophilic characteristics or polar molecules are those in which there exists a dipole moment or separation of charge. This "Metallophilic characteristic" allows lubricant molecules to adsorb to the metal surface in a preferred orientation to inhibit metal to metal contact and provide lubrication. Lubricant molecules are held to the metal surface by weak attractive forces also known as Van der Waal's forces.

The synergistic lubricant blend forms a preferred orientation with excellent molecular density and film strength provided by lateral cohesive forces due to components in the synergistic lubricant blend such that the molecular film may resist penetration of asperities and prevent metal to metal contact.

Additionally, the lubricant of this invention preferably contains from 10 to 25 weight percent of a conventional detergent additive for engines, of a type that is presently available for that purpose.

It is also preferred for ingredient (1), the saturated fatty acid, to be present in the amount of 40 to 55 weight percent and to have an even number of carbon atoms numbering at least 14. Such fatty acids are readily obtainable and of generally low cost.

Ingredient (2) is preferably present in an amount of 7 to 25 weight percent.

Preferably at least 10 weight percent of ingredient (3), the polybasic ester, is present in the composition, and most preferably 20 to 40 percent.

The lubricant blends in accordance with this invention may be mixed at preferably elevated temperatures on the order of 120–150 degrees F., and they typically are molded into a desired pill form. The resulting pills may be dropped into a container of gasoline where they readily disperse into the gasoline with a small amount of shaking or standing. Then, the gasoline fuel is ready to be used in a two-cycle engine.

A color dye may also be included in the formulation as an indicator that the fuel is ready for 2-cycle use.

The above disclosure and the following examples are offered for illustrative purposes only, and are not intended to limit the scope of the invention of this application, which is as defined in the claims below.

EXAMPLE 1

The following lubricant blend was prepared by first melting tetradecanoic acid and then adding the remaining ingredients at a temperature of about 130 degrees F. with blending until uniform. The formulation comprises the following ingredients:

| Product Name | Percent by Weight | |
|---|---|---|
| Tetradecanoic acid | 50% | Prifrac 2940 |
| Trimethylol Propane Ester | 24% | Priolube 3999 |
| Engine Detergent | 18% | Lubrizol 397C |
| Dimeric Fatty Acid (primarily a mixture of dimerized, unsaturated fatty acids of C12–C18) | 8% | Propal 1013 |

The blended, homogenous material was poured into molds to form molded tablets therefrom, and allowed to cool to a solid tablet, which tablets were brown, relatively hard, and having a melting point of 105° F.

When the resulting tablets are placed into gasoline, they quickly disperse to form a lubricant mixture with the fuel.

EXAMPLE 2

In a manner similar to that of Example 1, the same ingredients were mixed into a homogenous mixture of the following proportions:

| Product Name | Percent by Weight |
|---|---|
| Tetradecanoic Acid | 44% |
| Trimethylol Propane Ester | 34% |
| Engine Detergent (ashless additive LZ397C) | 14% |
| Dimeric Fatty Acid (similar to Example 1) | 8% |

The resulting molded tablets were solid brown in color, having a melt point of 107° F. to 110° F. These tablets also dispersed readily in gasoline to provide a lubricating component thereto.

EXAMPLE 3

Another mixture was prepared of four ingredients by mixing at a temperature of about 130° F. until homogeneous. The components of the mixture were:

| Product Name | Percent by Weight |
|---|---|
| Octadecenoic Acid | 45% |
| Trimethylol Propane Ester | 34% |
| The Engine Detergent of Example 2 | 14% |
| Dimeric Fatty Acid (Similar to Example 1) | 7% |

This material was also a solid brown having a melt point of 120° F. to 123° F. The tablets were readily dispersible in engine fuel as in the previous examples.

EXAMPLE 4

In a manner similar to Example 3, a formulation of the following ingredients was prepared:

| Product Name | Percent by Weight |
|---|---|
| Octadecanoic Acid | 44% |
| Dibasic Polyol-Acid Ester (Mobil DB81) | 33% |
| The Engine Detergent of Example 2 | 15% |
| Dimeric Fatty Acid (Similar to Example 1) | 8% |

The resulting tablets as formed in the previous examples were relatively soft and solid brown, having a melting point of 121° F.

EXAMPLE 5

Another mixture of four ingredients was prepared by heating and blending at 130° F. until uniform and then cooling in a tablet mold. The four ingredients were:

| Product Name | Percent by Weight |
|---|---|
| Tetradecanoic Acid | 47% |
| Dibasic Polyol-Ester (Mobil DB81) | 31% |
| The Engine Detergent of Example 2 | 15% |
| Dimeric Fatty Acids (similar to Example 1) | 7% |

The resulting tablets were similar in look and performance to those of the previous examples.

EXAMPLE 6

Another formulation of four ingredients was prepared in accordance with the previous examples and formed into tablets. The mixture was:

| Product Name | Percent by Weight |
|---|---|
| Hydrogenated Tallow Fatty Acids | 47% |
| Synthetic Polybasic Ester Lubricant Basestock (Emery 2900) | 31% |
| Engine Detergent (Paramins 13970) | 14% |
| Dimeric Fatty Acids (Similar to Example 1) | 8% |

The resulting tablets were blue, solid, and medium hard, having a melting point of about 112° F. They were also readily dispersed in gasoline to provide a lubricating function thereto.

EXAMPLE 7

The product tablets (some of which were in the shape of molded rods) of Example 2 were tested to determine their two-cycle lubricant class and a determination of their lubricity as two-cycle gasoline lubricants. Amoco 92 octane fuel was used as the fuel for the samples, while the control sample was reference oil Citgo 93738, #784C59 mixed into the fuel. Tablets of the solid lubricant of Example 2 were added to various portions of the fuel to provide respective dilutions of 96:1, 190:1, and 300:1. The lubrication test was then performed on a Yamaha motorcycle engine in accordance with ASTM test D4857-88.

At the 96:1 ratio and the 190:1 ratio, the lubricant formulation of this invention performed better than the reference oil as a lubricant. At the 300:1 ratio the lubricant of this invention performed marginally worse than the reference oil, the concentration of the reference oil in fuel being constant in each test at 150:1, which is essentially a minimum effective concentration for the reference oil.

Accordingly, it can be concluded that the fuel formulation of this invention can provide equal or improved performance to conventional good lubricating oil for two-cycle fuel at concentrations that are substantially less than the minimum effective concentration of such lubricating oil.

EXAMPLE 8

Another mixture was prepared of five ingredients by mixing at an elevated temperature until homogenous. The components of the mixture were:

| Product Name | Percent by Weight |
|---|---|
| Tetradecanoic Acid | 45.5% |
| Priopol 1025 Dimeric Fatty acids | 4.97% |
| Polyisobutylene having a molecular weight of about 1000 (Lubrizol 3108) | 18.93% |
| Trimethylolpropane Ester (Prolube 3999) | 17.7% |
| Two-Cycle Cleanliness Additive (Lubrizol 390) | 12.9% |

The mixed formulation was poured into a tablet mold and allowed to cool to form tablets that are readily dispersible in gasoline,

EXAMPLE 9

Another formulation of five ingredients was prepared in accordance with the previous examples and formed into tablets, The mixture was:

| Product Name | Percent by Weight |
|---|---|
| Tetradecanoic Acid | 44% |
| Ferrocene (as a combustion aid) | 2.0 |
| | 2.0 |
| Engine Detergent (Lubrizol 390) | 18.0 |
| The Polyisobutylene of Example 8 | 26.0 |
| The Trimethylol Propane Ester of Example 8 | 10.0 |

EXAMPLE 10

Another formulation of four ingredients was prepared in accordance with the previous examples and formed into tablets. The mixture was:

| Product Name | Percent by Weight |
|---|---|
| Tetradecanoic Acid | 45.0% |
| The Trimethylol Propane Ester of Example 8 | 19.0% |
| The Polyisobutylene of Example 8 | 19.0% |
| Engine Detergent (Lubrizol 390) | 17.0% |

Engine testing of such a mixture was performed on a two-cycle engine by adding twenty grams of such mixture per one gallon of fuel which represents a concentration of 180:1, plus another test at sixteen grams per gallon of fuel or 222:1 as a separate test. Good engine lubrication was provided by such a formulation at such concentrations.

An additional feature of the solid pellets of the various examples is that the pellets will float in water, from where they may be retrieved and still used for the preparation of two-cycle engine fuel by dispersal in gasoline in a desired concentration.

That which is claimed is:

1. A hydrocarbon fuel soluble, solid lubricant for addition to two-cycle engine fuel and substantially spontaneous dispersion therein, to provide lubrication to a two-cycle engine using said fuel, said solid lubricant being shaped in the form of a pellet having a diameter of at least 1 mm. up to 4 cm.; said solid lubricant comprising (1) from 25 to 75 weight percent of a saturated fatty acid having 12 to 22 carbon atoms; (2) from 5 to 40 weight percent of at least one polymer selected from the group consisting of polyisobutylene having a molecular weight of at least about 800, and polymerized, unsaturated fatty acids having an average of at least about 24 carbon atoms per polymerized molecule; and (3) from 10 to 50 weight percent of a polybasic ester of a polyol molecule and 2 to 4 fatty acid molecules, each fatty acid molecule having 4 to 22 carbon atoms.

2. The solid lubricant of claim 1 which also contains from 10 to 25 weight percent of a detergent additive for engines.

3. The solid lubricant of claim 2 in which ingredient (1) has an even number of carbon atoms numbering at least 14.

4. The solid lubricant of claim 2 in which ingredient (2) consists essentially of a dimer of linoleic acid.

5. The solid lubricant of claim 2 in which ingredient (3) is a tribasic acid ester of trimethylol propane.

6. The solid lubricant of claim 2 in which from 40 to 55 weight percent of ingredient (1) is present.

7. The solid lubricant of claim 2 in which from 7 to 25 weight percent of ingredient (2) is present.

8. The solid lubricant of claim 2 in which from 20 to 40 weight percent of ingredient (3) is present.

9. A hydrocarbon fuel soluble lubricant pellet which comprises (1) from 25 to 75 weight percent of a saturated fatty acid having 12 to 22 carbon atoms, (2) from 5 to 40 weight percent of polyisobutylene having a molecular weight of at least about 800; and (3) from 10 to 50 weight percent of a polybasic ester of a polyol molecule and 2 to 4 fatty acid molecules, each fatty acid molecule having an average of 4 to 22 carbon atoms.

10. The lubricant of claim 9 which also contains from 10 to 25 weight percent of a detergent additive for engines.

11. The lubricant of claim 9 in which ingredient (1) has an even number of carbon atoms numbering at least 14.

12. The lubricant of claim 9 in which from 40 to 55 weight percent of ingredient (1) is present.

13. The lubricant of claim 9 in which from 7 to 25 weight percent of ingredient (2) is present.

14. The lubricant of claim 9 in which from 20 to 40 weight percent of ingredient (3) is present.

15. The lubricant of claim 9 in which ingredient (2) consists essentially of a dimer of linoleic acid.

16. The lubricant of claim 9 in which ingredient (3) is a tribasic acid ester of trimethylol propane.

17. The lubricant of claim 9 in which said polyol molecule is monomeric.

18. A two-cycle engine fuel composition which comprises a mixture of gasoline and the hydrocarbon fuel-soluble lubricant of claim 7 in a concentration of 1 part by weight of said lubricant per 100 to 300 parts by weight of said gasoline.

19. A lubricating process for two-cycle engines which comprises the steps of:

providing a solid lubricant pellet having a diameter of at least 1 mm. up to 4 cm. and comprising a hydrocarbon fuel-soluble lubricant;

introducing two-cycle engine fuel to a fuel tank of a two-cycle engine; and introducing said solid pellet to the fuel tank of the two-cycle engine in a concentration of one part by weight of said solid lubricant to 100–300 parts by weight of said two-cycle engine fuel, whereby said solid pellet disperses in said two-cycle engine fuel substantially spontaneously to form a lubricant mixture with the fuel; said solid pellet comprising (1) from 25 to 75 weight percent of a saturated fatty acid having 12 to 22 carbon atoms; (2) from 5 to 40 weight percent of at least one polymer selected from the group consisting of polyisobutylene having a molecular weight of at least about 800, and polymerized, unsaturated fatty acids having at least one average of at least about 24 carbon atoms per polymerized molecule; and (3) from 10 to 50 weight percent of a polybasic ester of a polyol molecule and 2 to 4 fatty acid molecules, each fatty acid molecule having 4 to 22 carbon atoms.

20. The process of claim 19 in which said solid lubricant further contains from 10 to 25 weight percent of a detergent additive for engines.

* * * * *